US007154468B2

(12) United States Patent
Linzmeier et al.

(10) Patent No.: US 7,154,468 B2
(45) Date of Patent: Dec. 26, 2006

(54) METHOD AND APPARATUS FOR IMAGE OPTIMIZATION IN BACKLIT DISPLAYS

(75) Inventors: Daniel A. Linzmeier, Wheeling, IL (US); Robert J. Bero, Spring Grove, IL (US); Charles P. Binzel, Bristol, WI (US); Robert M. Johnson, Lake Zurich, IL (US); Timothy M. McCune, Cary, IL (US); Edward J. Yurchik, Crystal Lake, IL (US)

(73) Assignee: Motorola Inc., Schaumburg, IL (US)

( * ) Notice: Subject to any disclaimer, the term of this patent is extended or adjusted under 35 U.S.C. 154(b) by 0 days.

(21) Appl. No.: 10/721,988

(22) Filed: Nov. 25, 2003

(65) Prior Publication Data

US 2005/0110740 A1 May 26, 2005

(51) Int. Cl.
*G09G 5/00* (2006.01)

(52) U.S. Cl. ..... 345/102; 345/90

(58) Field of Classification Search ..... 345/87–88, 345/72, 77, 150, 102, 211, 98, 78, 81, 63, 345/90, 93, 100, 690; 348/333.02, 333.12, 348/234; 349/30, 61; 362/30, 246, 800
See application file for complete search history.

(56) References Cited

U.S. PATENT DOCUMENTS 5,170,443 A * 12/1992 Todd ..... 382/274
5,228,120 A * 7/1993 Farr et al. ..... 345/593
5,371,615 A 12/1994 Eschbach
5,428,265 A * 6/1995 Booth et al. ..... 315/158
6,078,307 A 6/2000 Daly
6,243,059 B1 * 6/2001 Greene et al. ..... 345/88
6,301,050 B1 10/2001 DeLeon
6,542,138 B1 * 4/2003 Shannon et al. ..... 345/76
6,621,482 B1 * 9/2003 Fuller ..... 345/102
2002/0030660 A1 * 3/2002 Arakawa ..... 345/102
2002/0060662 A1 * 5/2002 Hong ..... 345/102
2002/0063674 A1 5/2002 Chiang
2002/0122020 A1 9/2002 Moon et al.
2002/0195954 A1 * 12/2002 Kim ..... 315/149
2003/0001815 A1 * 1/2003 Cui ..... 345/102
2003/0122951 A1 * 7/2003 Hara et al. ..... 348/333.02
2005/0068332 A1 * 3/2005 Diefenbaugh et al. ..... 345/604

OTHER PUBLICATIONS

"Current Regulated Switched Capacitor LED Driver with Analog Brightness Control," National Semiconductor, Jul. 2002.
Smith, et al. "Color Gamut Transform Pairs," (pp. 12-19).

* cited by examiner

*Primary Examiner*—Nitin Patel
(74) *Attorney, Agent, or Firm*—Randall S. Vaas

(57) ABSTRACT

A display apparatus 200, a display controller 222, and a method for optimizing a displayed image for use in an electronic device 100 comprising a display 208 for presenting a visual image, a processor 212 for determining the intensity of a backlight 216 used for illuminating the display 208 and a controller 202 that optimizes the visual image corresponding to the intensity of the backlight 216 are described. As the intensity of the backlight 216 is reduced, the brightness of the pixels 210 is increased to compensate the image when, for example, the backlight intensity is reduced to save power. The method and apparatus are also described for compensating for uneven backlight 216 conditions.

33 Claims, 3 Drawing Sheets

METHOD AND APPARATUS FOR IMAGE OPTIMIZATION IN BACKLIT DISPLAYS

TECHNICAL FIELD

This invention relates in general to electronic devices with displays, and more specifically to a method and apparatus for image optimization in backlit displays.

BACKGROUND

Battery life and the corresponding operating time between battery recharges in electronic devices is a key success factor for acceptance in the marketplace. The power consumed by a display is a critical element in overall power consumption in an electronic device. This is especially true with the trend to larger displays. Moreover, the addition of color displays significantly increases the need for power management in these devices. In most lighting situations, a backlight is required by a color liquid crystal display ("LCD") to achieve the highest image quality. A color LCD display without sufficient background light is often perceived as washed out and flat. A bright backlight, however, is a significant drain on an electronic device. The level of the backlight can be reduced to improve battery life but can result in reduced readability and clarity.

BRIEF DESCRIPTION OF THE DRAWINGS

The accompanying figures, where like reference numerals refer to identical or functionally similar elements throughout the separate views and which together with the detailed description below are incorporated in and form part of the specification, serve to further illustrate various embodiments and to explain various principles and advantages all in accordance with the present invention.

DETAILED DESCRIPTION

Figure 1:
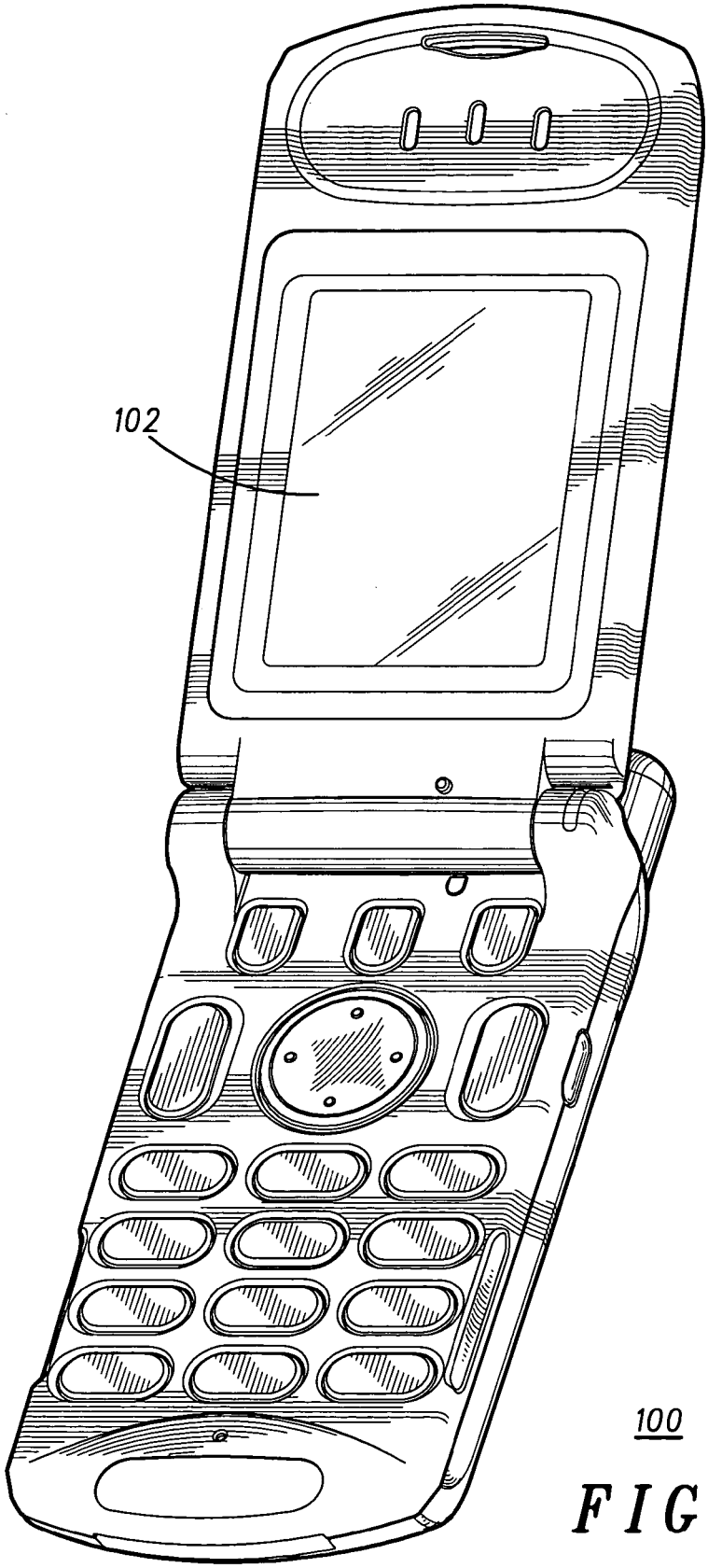
FIG. 1 illustrates a typical electronic device with a color display.

In overview, the present disclosure concerns electronic devices that use LCD displays, particularly color LCD displays. More particularly, various inventive concepts and principles embodied in the methods and apparatus for use in optimizing the viewable image on a color LCD when a backlight is adjusted are discussed. This is of particular interest in portable electronic devices where a user has had to choose between a bright, high contrast image with a short operating time and a harder-to-view image with a longer operating time. The operating time being driven at least in part by backlight power consumption.

As further discussed below various inventive principles are advantageously employed to optimize the displayed image when the backlight levels are adjusted, particularly to prolong battery life. When the displayed image becomes washed out, dim or flat-looking, users of electronic devices will often choose to keep the backlight on and accept the reduced battery life, often to their detriment should the electronic device become unusable later. When incorporated in an electronic device, the instant disclosure provides for compensating the image display to encourage users to operate with lower backlight levels and preserve the battery, correspondingly lengthening the operating time.

The instant disclosure is provided to further explain in an enabling fashion the best modes of making and using various embodiments in accordance with the present invention. The disclosure is further offered to enhance an understanding and appreciation for the inventive principles and advantages thereof, rather than to limit in any manner the invention. The invention is defined solely by the appended claims including any amendments made during the pendency of this application and all equivalents of those claims as issued.

It is further understood that the use of relational terms, if any, such as first and second, top and bottom, and the like are used solely to distinguish one from another entity or action without necessarily requiring or implying any actual such relationship or order between such entities or actions.

Much of the inventive functionality and many of the inventive principles are best implemented with or in software programs or instructions and integrated circuits (ICs) such as application specific ICs. It is expected that one of ordinary skill, notwithstanding possibly significant effort and many design choices motivated by, for example, available time, current technology, and economic considerations, when guided by the concepts and principles disclosed herein will be readily capable of generating such software instructions and programs and ICs with minimal experimentation. Therefore, in the interest of brevity and minimization of any risk of obscuring the principles and concepts in accordance to the present invention, further discussion of such software and ICs, if any, will be limited to the essentials with respect to the principles and concepts of the preferred embodiments.

FIG. 1 illustrates a typical electronic device 100 with a color display 102. The user is often able to adjust or select a level of backlight via one or more elements of a user interface. In other cases, the level of the backlight is adjusted automatically based on one or more conditions such as inactivity, modes of operation or ambient light level.

Cellular phones, personal digital assistants, organizers, personal games, and portable entertainment systems incorporating displays that would benefit from an embodiment of the present disclosure are in common use and are readily available at retail establishments. In most cases this is a color LCD display but other configurations including grayscale or other color display technologies can be envisioned.

Figure 2:
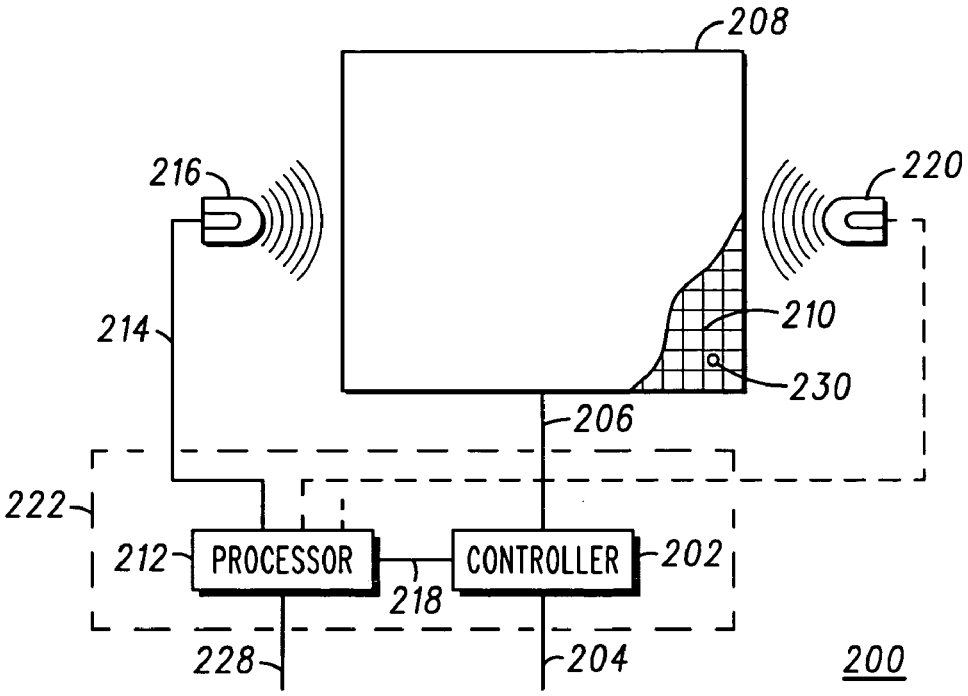
FIG. 2 depicts, in a simplified and representative form, a block diagram of a display apparatus for use in an electronic device.

Referring to FIG. 2, a simplified and representative block diagram of a display apparatus 200 for use in an electronic device is discussed and described. The electronic device may be a wireless communication device, a personal digital assistant or any other of a number of electronic devices that use LCD displays and could benefit from reduced power consumption. A controller 202 has an input 204 and an output 206. The output 206 may be a multiplexed set of connections for driving a display 208. The display 208 most often includes individual pixels 210 forming a pixel array. A processor 212 having an output 214 may be used to drive a backlight 216 for illuminating the display 208. The processor 212 may be coupled to the controller via a connection 218 for communicating the level or intensity of the backlight 216 and for accessing pixel data. Depending on the physical configuration of the display apparatus and the specific electronic device, one or more additional backlights 220 may be employed also driven by the processor 212. The processor and controller may be disposed physically or logically in a single device 222 as depicted.

In operation, a display apparatus 200 for use in an electronic device 100 may have a display 208 for presenting a visual image, a processor 212 for determining an intensity of a backlight 216 for illuminating the display 208, and a controller 202 coupled to the display 208 and the processor 212 for optimizing the visual image corresponding to an intensity of the backlight 216. The level of the backlight 216 may be selected by the user via some form of the user interface or may be adjusted automatically by the processor 228 based on another factor. Such factors may include ambient light, time since a key press, remaining battery power, or others. For example, in some conditions the backlight level may need to be at its highest intensity resulting in a sacrifice of some battery life for the user to be able to see the display well. There may be a case when the electronic device 100 is equipped with a light sensor and could sense that given a dark ambient light condition, such as at night, the backlight can be reduced to a predetermined low level. In another instance, perhaps indoors, the user may want to reduce the level of the backlight to save power and might be willing to sacrifice some quality of the displayed image.

The nature of a color display, especially an LCD display 208 is that the screen is divided into small segments called pixels 210. A pixel 210 can vary in size depending on the resolution of the display and the type of construction. The hue, saturation, and brightness of each pixel 210 are most often determined according to red, green and blue ("RGB") sub-element settings for the pixel 210. In some embodiments other color spaces can be used such as cyan, magenta, yellow, however, the principles discussed regarding RGB apply equally. By adjusting the RGB settings for a pixel 210 not only the hue and saturation, but the value or brightness can be set. The visual image can be optimized by adjusting the red, green and blue settings for each of the pixels 210 in the array. One such measure of hue, saturation, and brightness is defined by Smith, A. R. in the SIGRAPH 78 paper titled "Color Gamut Transform Pairs." Mapping between hue, saturation, and value (or brightness, or lightness) can be found in "Computer Graphics" by Foley, et al. Measures of hue and saturation are defined in HSV (Hue Saturation Value), HSB (Hue Saturation Brightness), HLS (Hue Lightness Saturation) color spaces know by practitioners of ordinary skill in the art. Keeping a constant scaling between red, green, and blue settings when making the adjustment allows the value, brightness, lightness, or luminance of a pixel 210 to be changed without changing the hue and saturation of the pixel 210. This can be accomplished by scaling the original settings by the same scale factor or by increasing each value by the same percentage increase. Since the procedures, methods, and apparatus are the same for scaling red, green, and blue settings to adjust the value, brightness, lightness, or luminance, while maintaining hue and saturation, the terms brightness will be used to describe the pixel value, brightness, lightness, or luminance henceforth. The human eye may be considered when working with colors as the eye is more sensitive to changes in brightness than changes in color. Therefore, a strict ratio adjustment may not always be used when changing brightness and maintaining hue and saturation.

Applying this characteristic of an LCD display 208, an image can be optimized by increasing the brightness of a pixel 210 as the backlight 216 level is decreased. In other words, the visual image may be optimized by adjusting the brightness of the pixel inversely proportionally to the intensity of the backlight 216. The integrity of the image is preserved by maintaining the hue and saturation of each pixel of the pixel array.

In one example where a pixel 210 may already have a relatively high brightness and the backlight 216 is reduced in intensity, one or more of the red, green, blue settings may require adjustment beyond a maximum setting. For the sake of illustration, let us assume that the red, green and blues settings for a pixel 210 can range from 0–255. In the exemplary instance, red is at 200, green is at 150 and blue is at 100, resulting in a medium brown hue. A 15% decrease in backlight 216 intensity (as measured by current driving the light, a light sensor, or other mechanism) is followed by a corresponding increase in pixel 210 brightness, for example 20%, as may be empirically derived as having the best effect. A 20% increase results in new red, green, and blue values of 240, 180, and 120, respectively, resulting in a lighter shade of brown, providing higher brightness while still maintaining the hue. However, when a 35% decrease in backlight 216 intensity occurs, and the pixel 210 value is adjusted up a corresponding 35%, for example, the resulting red value of 270 would exceed the maximum. In an exemplary embodiment, the red value may be set to 255, establishing an increase ratio of (255–200)/200 of 27.5%. The remaining green and blue values are each increased by 27.5% giving final settings for the pixel 210 (rounded to a whole number) of 255, 191 and 128 respective to red, green and blue. This is still a brown hue and has the highest brightness available while maintaining that hue. That is, the red, green and blue settings are adjusted inversely proportionally to the intensity of the backlight until the maximum setting would exceed a limit value. Then, that setting is set to a maximum value and the percentage increase of that setting is used to increase the remaining settings. The ability to calculate that a pixel has reached a limit value at a given backlight level may be used to adjust the backlight level to point at or near impending brightness saturation, giving a mix of full color intensity and backlight level.

This use of ratio adjustments and limit values may also apply to a dark hue (low red, green, blue settings) when the backlight intensity is increased. A corresponding reduction in a hue or brightness may result in an effective loss of any hue (black) if the color elements are all reduced equally. Again, a limit value may apply so that the luminance is not lowered to a point where contrast is lost and any image presented is simply black. In this case a lower limit, for example 50, may be set. When any value would be reduced below 50 when adjusting to a brighter backlight, the value most below 50 would be set to 50 and the percentage decrease of that setting would be used to decrease the value of the remaining setting.

Figure 4:
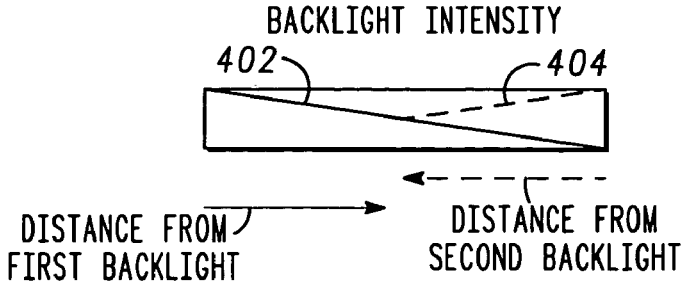
FIG. 4 depicts backlight intensity as a function of distance from the backlight source.

Referring briefly to FIG. 4, As shown by the line 402, representing backlight 216 intensity across a horizontal section of the display, the light supplied by the backlight diminishes with increased distance from the light source. This can be due simply to the geometry of the placement of the backlight 216 with respect to the display 208 or due to the optics used for channeling the light from the backlight 216 to the display 208. It can be seen that given the single light source example using backlight 216 that the display will be brighter on the left side of the screen than on the right. One way to describe this effect is luminance roll off. The ability to adjust the luminance (brightness) of the display 208 on a pixel-by-pixel basis allows the designer of the electronic device to compensate for the light intensity difference without more expensive optics or additional backlights 220. In the example, the brightness of pixels on the right side of the display 208 can be adjusted to more closely match those on the left side of the display 208. When a second backlight is used, such as 220, or when different optics are employed, the lighting pattern on the display may be altered, as shown by the graph line 404 illustrating the effect of the second backlight. In the two backlight 216 220 case, the pixels in the center of the display 208 can be adjusted to match those on each edge according to the luminance roll off shown by lines 402 and 404. While the sample in FIG. 4 shows a linear luminance roll off, it will be evident to one of ordinary skill in the art that such a change in backlight intensity may be highly non-linear both across the width and the height of the display 208 and corresponding changes to the image optimization algorithm may be required.

Returning to FIG. 2, the controller 202 may use any of several methods to calculate a new value for a pixel 210 in the pixel array when a change in backlight 216 level occurs. In one exemplary embodiment, the controller may optimize the visual image by adjusting all pixels in the pixel array by a fixed value according to a look up table. As an example to be used strictly for illustrative purposes, a table may describe that for a reduction in backlight 216 level of about >0% to about 15% an increase in pixel brightness of 8%–10% will be applied. Backlight 216 reductions from about >15% to about 25% can result in an 18%–20% increase in pixel luminance. Any such adjustment can be made while maintaining hue and saturation while accounting for maximum values as described above. In another embodiment, each pixel 210 can be adjusted by calculating in real time a new value for that pixel 210 based on the change in backlight 216 intensity, and may or may not include compensation for backlight display variation as described above. In yet another embodiment, the pixel array may be broken into portions and a new adjustment value for that portion calculated and applied to the pixels 210 therein.

In one embodiment, for example when displaying live video, the processor 212 may be called upon to enhance the image in real time. In another embodiment, for example when display 208 changes are not as rapid, the controller 202 may be driven from a front memory while the contents for a next display screen are processed for image enhancement in a back memory. The processor 212 can read out sections of the back memory, for example rectangular areas of the display, process the image, and rewrite the data to the back memory. When all pixel 230 values have been updated the processor 212 can signal the controller 202 to switch from the front to the back memory to change the displayed image. Essentially, the back memory is made the front memory, the former front memory is available for writing new display data and for image optimization. The front and back display memory are often part of the controller 202 but may be separate. In one embodiment, access to the display memory is made using OpenGL™ software calls. OpenGL™ is a trademark of Silicon Graphics, Inc.

The components shown in FIG. 2 are known and available. The controller 202 is or may include a digital signal processor or another controller available from Motorola, Inc. or other manufacturers. Similarly, the processor 212 may be or may include a digital signal processor from Motorola, Inc. or other manufacturers. The processor 212 and controller 202 may functionally operate on the same chip and be expressed in software or hardware. Whether implemented in hardware (such as in a programmable logic array) or software (in C++, Java or other computer operable instructions) implementation of the functions described for the processor 212 and controller 202 are easily understood and implemented by a practitioner of average experience and capability in the field. In one embodiment the display controller may be an ATI Imageon™ 3200 display controller used with a National Semiconductor LM2791 LED driver, although other combinations can be made at the discretion of one of ordinary skill in the art. Imageon™ is a trademark of ATI Technologies, Inc. The backlights 216 220 may be cold fluorescent lights (CFL), electroluminescent lights (EL), light emitting diode (LED) or other device or combination thereof. They are commodity parts and are available from manufacturers such as Kyocera and component distributors such as Arrow Electronics or Hamilton Avnet. A number of displays 208 are in production and available from manufacturers such as Kyocera, Hitachi or others.

Similar to the above, a display controller 222 provides an image optimized to a backlight intensity. The display controller has a first input 204 for receiving a data to display as the image and a second input 228 corresponding to a backlight intensity of a display. The display 208 being driven may be composed of pixels 210 in a pixel array. The display controller further comprises an output 206 for controlling one or more of the pixels 210 of the pixel array. The display controller also has a processor 212 or controller 202 for adjusting the brightness of the pixels 210 of the pixel array in response to changes in one or both of the inputs 204 228. One of the display controller 222 inputs, for example 228, may correspond to the backlight intensity directly. Alternately, the display controller input 228 may be data related to, for instance, keyboard activity, and is used by the display controller 222 for programmatically setting the backlight intensity. Whether via monitoring the backlight intensity or controlling it, the display controller 222 is aware of the backlight intensity for use in optimizing the image.

The processor 212 or controller 202, as part of the display controller 222, may optimize the visual image based on the backlight intensity according to one of a fixed value look up and a real-time calculation.

The processor 212 or controller 202 may adjust the value for one of the red, green or blue pixel elements in inverse proportion to the backlight intensity to compensate for the different level of backlight available. The brightness of the pixel 210 can be maintained by adjusting each of the elements (red, green and blue) of the pixel in the same proportion.

When the adjustment in inverse proportion to the backlight level would cause one of the red, green, or blue element values to exceed a limit value, that setting is set to a maximum value and the percentage increase of that setting is used to increase the remaining settings. In a case where all values or values from several pixels exceed the limit, the value most exceeding the limit is set to the maximum and is used to determine the other adjusted values. This allows maintaining the hue and saturation of the pixel 210 while affording the maximum adjustment available.

The display controller may be programmed to allow separately calculating the adjustment in inverse proportion to the backlight level so that some portions of the display are adjusted to different levels, have different limits, or use a different proportion than other areas of the display. As described above, this may be used to compensate for displays where the backlighting is not uniform.

The display controller 222 may be any of a number of controllers, single chip processors or programmable arrays available from manufacturers such as Motorola, Inc. In one embodiment the display controller can an ATI Imageon™ 3200 Graphics controller. The functions described may be implemented in hardware, firmware or software and is easily accomplished by one of average skill in the art. The conversion of a design in one form to another form is known to those of ordinary skill in the art.

Figure 3:
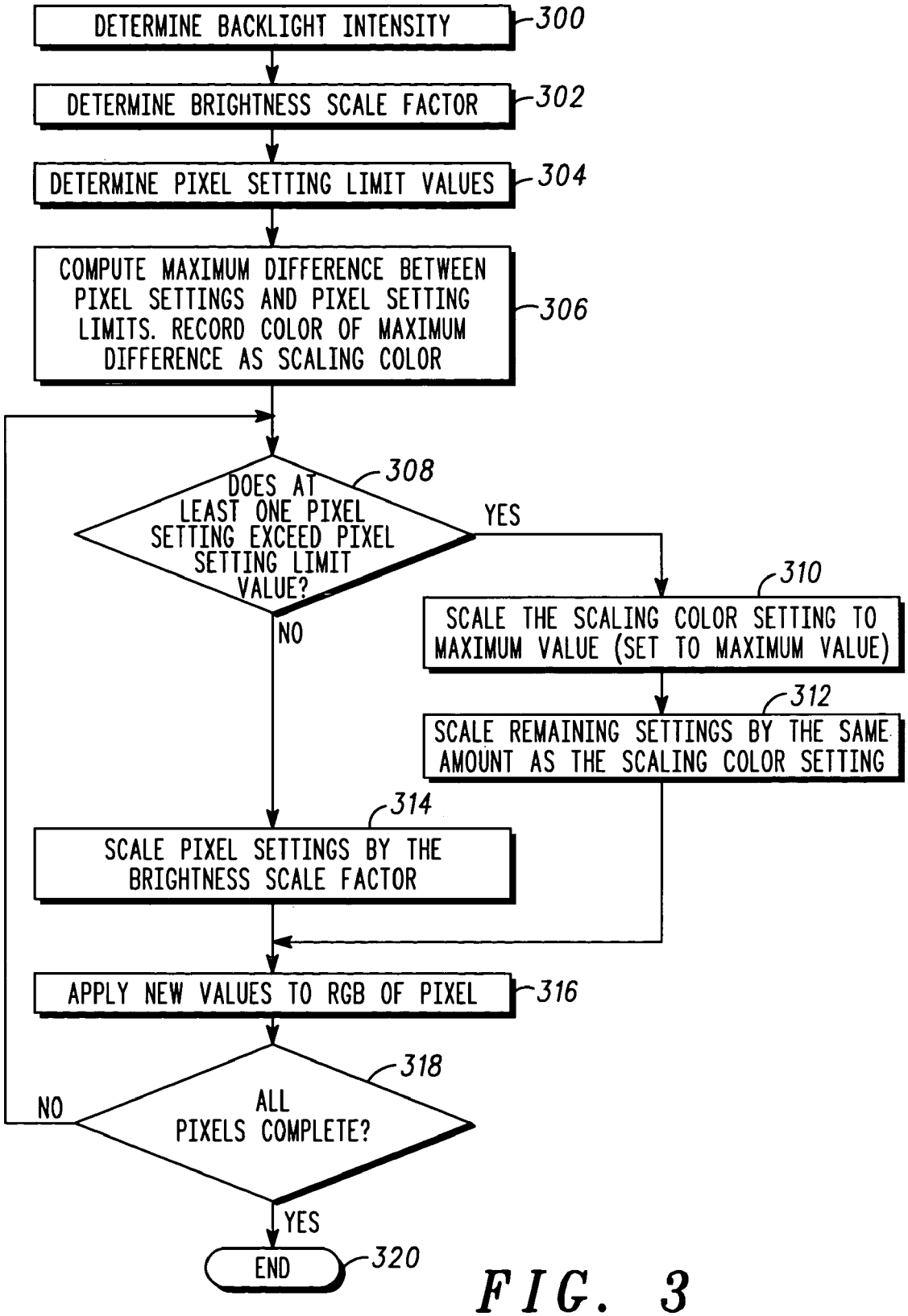
FIG. 3 is a method for LCD display compensation when backlight adjustments are made.

Referring to FIG. 3, a method for LCD display compensation when backlight adjusts are made is discussed and described. The method optimizes an image in a display of an electronic device when the backlight intensity changes by first determining 300 a backlight intensity, or more appropriately, a change in the backlight intensity. In some cases, the backlight intensity may be viewed as a difference from a known state, that is, for example, 50% below a maximum level. In another embodiment, the backlight intensity, and a change thereof, may be expressed in terms corresponding to the energy used to drive the backlight, for example, milliamps of drive current. Once the backlight intensity is determined, a brightness scale factor is calculated 302, that is, a factor for adjusting the image according to the intensity of the backlight is determined. In one embodiment, a constant value brightness scale factor may be determined for all pixels 210 in the display by calculating a percentage change to apply based on a percentage change in the backlight intensity. In another embodiment, a constant value brightness scale factor may be determined for all pixels 210 according to a predetermined table of values that may be empirically derived for a particular display configuration and may have the benefit of speed over real-time calculation of a scaling factor. A second table of scale factors may also be calculated wherein the table contains an entry for each color component value, from 0 to a maximum. In yet another embodiment, variations in the backlight level at different areas of the screen may be accounted for. After a brightness scaling factor is determined, a second factor, based on the intensity of the backlight in a portion of the screen may be used for adjusting the image in that portion of the display. This is particularly applicable in situations where, due to optics or uneven distribution of the light from the backlight, some areas of the screen are always brighter than others. Adjusting the brightness according to both the change in backlight intensity and the change in observed intensity at a given location allows for creating a perceived uniformity across the display viewing area.

A further consideration in determining the brightness scaling factor is maintaining the hue and saturation of the image. In a display characterized by pixels 210 composed of red, green and blue primary colors care may be exercised to adjust each of the three elements proportionally to maintain the hue and saturation of the displayed image.

A limit value for the pixel elements or color components is determined 304. The limit may be one imposed by the display itself, that is a maximum luminance or brightness supported, or it may be an empirical limit, such as a low value determined to be needed for color discrimination or observed color saturation. The limit may be different for different areas of the screen. As discussed above, the screen may be divided into sections for ease of calculation or to simplify compensation for backlight variations.

The color component values are tested 308 to see if they exceed a color component limit value. If any of the element or color component values exceed the limit, the yes branch of 308 is followed. When the magnitude of the one or more of the red, green or blue elements exceeds a limit value, the setting exceeding the limit by the greatest amount can be set 310 to the maximum value or another predetermined value. The settings for the remaining color component values are increased 312 by the same percentage increase as the highest original color component value. When determining a brightness value, that is, the magnitude of the red, green and blue pixel settings, in a limit situation, it is desirable to maintain the original hue and saturation of the pixel 210 but not necessary. Variations from strict proportional adjustments can be accommodated for speed of calculation, rounding errors, or table look up matching. The method continues at 316.

When no setting exceeds a limit established for it, or when hue and saturation are not maintained, as when maximum values are reached and proportionality is not maintained, the no branch of 308 is followed to 314. The new values for red, green, and blue settings are applied 314 to the image at the pixel 210 to adjust the image using the brightness scale factor. In practice, one embodiment reads display values from the controller 202, operates on the image, either in whole or in parts, and then rewrites the optimized data back into the controller 202. A test 316 is performed to determine if all pixels or sections of the display have been adjusted. If not, the no branch of 316 is followed and the process continues at 306. If all processing is complete, the yes branch of 316 is followed and processing ends 318.

In a preferred embodiment, the new values of the magnitude of the red, green and blue elements are calculated 306 in a relationship that is inversely proportional to the change in intensity of the display. If limit values are not checked, processing continues at 314.

The apparatus and method discussed above, and the inventive principles thereof are intended to and will alleviate problems caused by changes in backlight intensity and variations across a display in backlight intensity. By making the display more readable and improving the overall appearance of the displayed image, a user will be more likely to operate the electronic device at a lower backlight level. Thus, the user will reap the benefits of longer battery life with an acceptable, if even perceptible, reduction in image quality of the display.

Further, beyond the direct benefit to the user in terms of longer battery life, the user will benefit from the perception of even backlighting across all areas of the screen, by the compensation of the brightness in pixels where the luminance rolls off. The benefit to the manufacturer is as apparent. The optics for use in backlight diffusion can be less expensive and the types of backlight sources employed may be broadened when the display apparatus 200 or display controller 222 is employed to provide uniformity of perceived image quality when variations in backlight luminance exist.

The display described in this illustration is a liquid crystal display but it is obvious to one of ordinary skill in the art that the technique described is applicable to other display types and configurations and for purposes other than those associated with power conservation. It is easily understood that plasma displays, conventional tube monitors and others are used in environments where the brightness is adjusted, for example, when room lighting changes. The ability to adjust the brightness while maintaining hue and possibly color saturation in those situations is advantageous and is a direct application of the methods and apparatus described herein.

One embodiment of implementing the method of FIG. 3 and FIG. 4 follows:

```
#include <stdio.h>
#include "math.h"
#include <gl/gl.h>
#include <gl/glu.h>
// Constants used to enhance test image
#define PIXEL_RECT_WIDTH 70
#define PIXEL_RECT_HEIGHT 12
#define PIXEL_BUFFER_SIZE          (4*PIXEL_RECT_WIDTH *
PIXEL_RECT_HEIGHT)
// These routines are provided as an example image enhancement
// implementation for the case where three pixel settings are
// used (red, green, and blue). For a pixel array determined
// by the imageHeight and imageWidth parameters. When accessing
// pixels, each pixel setting is eight bits and can take on a
// value from 0 to 255.
// These routines assume that a double buffer (front and back buffer)
// have been configured.
void ScalePixels(
    unsigned int width,
    unsigned int height,
    unsigned char *pixelBuffer,
    unsigned char *ScaleTable,
    unsigned short *PixelScaleTable,
    unsigned int pixelLimit)
{
    enum primarycolor {mred,mgreen,mblue};
    unsigned char red,green,blue,max;
    unsigned int p;
    unsigned short pixelScaleFactor;
    primarycolor maxc;
    for (p=0; p<PIXEL_BUFFER_SIZE; p=p+4) {
        red       = pixelBuffer[p];
        green = pixelBuffer[p+1];
        blue      = pixelBuffer[p+2];
        // Compute maximum pixel setting
        if (red > green) { max = red; maxc = mred;} else {max =
green; maxc = mgreen;};
        if (blue > max)   { max = blue; maxc = mblue;};
        // determine if maximum pixel setting exceeds limit
        if (max > pixelLimit) {
            switch (maxc) {
                pixelScaleFactor = PixelScaleTable[max]; //
(255*256) / max
                case mred:
                    // Set setting to a maximum (255 for
this example)
                    // It could be set lower with lower
pixel limits
                    pixelBuffer[p]          = 255;
                    // Increase pixel setting
                    pixelBuffer[p+1] = (unsigned char)
(green * pixelScaleFactor) >> 8;
                    // Increase pixel setting
                    pixelBuffer[p+2] = (unsigned char)
(blue      * pixelScaleFactor) >> 8;
                    break;
                case mgreen:
                    // Set setting to a maximum 255 for
this example)
                    // It could be set lower with lower
                pixel limits
                    pixelBuffer[p+1] = 255;
                    // Increase pixel setting
                    pixelBuffer[p]          = (unsigned char)
(red   * pixelScaleFactor) >> 8;
                    // Increase pixel setting
                    pixelBuffer[p+2] = (unsigned char)
(blue * pixelScaleFactor) >> 8;
                    break;
                case mblue:
                    // Set setting to a maximum (255 for
this example)
                    // It could be set lower with lower
                pixel limits
                    pixelBuffer[p+2] = 255;
                    // Increase pixel setting
                    pixelBuffer[p] = (unsigned char)
```

-continued

```
(red      * pixelScaleFactor) >> 8;
                                // Increase pixel setting
                                pixelBuffer[p+1] = (unsigned char)
(green * pixelScaleFactor) >> 8;
                                break;
                }
            } else {
                pixelBuffer[p]   = ScaleTable[red];
                pixelBuffer[p+1] = ScaleTable[green];
                pixelBuffer[p+2] = ScaleTable[blue];
            }
        }
}
// ------------------------------------------------------------
// For this example, a table of values is computed where each
// entry has the value 256 * (255 / I). Where I is the index
// of each entry and the value 255 is taken to be the maximum
// setting for this example. This code generates a table of
// shifted scale factors for each possible maximum pixel setting.
// (assumed to be greater than the limit).
// Technically, the table could be shorter since only the entries
// pixel limit to 255 need to be maintained. However taking
// advantage of this would require an additional subtraction
// to compute the proper index during the actual scaling operation.
// In this example, pixel settings are scaled using the following
// procedure:
// new setting = (PixelScaleTable[max setting] * old setting) >> 8
// The last shift by 8 is required to account for the fact that the
// table is scaled up by a value of 256.
// This computation is essentially the same as the computation:
// new setting = PI(max setting) * old setting + old setting
// Where PI(max setting) represents the percentage increase of the
// maximum setting between its old setting value to its new setting
// value and PI + 1 = PSF, where PSF is a pixel scale factor defined
// as PSF = PixelScaleTable[max setting] >> 8 = (maximum setting) / I
// Here, essentially, new setting = PSF * old setting
// In the actual computations used for this example, the shift
// is performed after the multiplication to maintain precision.
// The multiplication and shift (scaling) is performed rather
// than a multiplication and an add (increasing by a percentage
// increase since some systems may be able to perform the former
// computation in less cycles. Note, other systems may be able to
// perform the latter computation in less cycle.
// ------------------------------------------------------------
unsigned short *ComputePixelScaleTable( )
{
    unsigned short *PixelScaleTable;
    unsigned int i;
    PixelScaleTable = (unsigned short *) malloc(256*sizeof(unsigned
short));
    PixelScaleTable[0] = 0;
    for (i=1; i<256; i++) {
        PixelScaleTable[i] = (unsigned short) ((255 * 256)/ i );
    }
    return PixelScaleTable;
}
// ------------------------------------------------------------
// For this example, a table of values is computed based on a
// a backlightIntensity which is proportional to the light level
// and inversely proportional to the brightness scale factor.
// brightnessScaleFactor = 1 / backlightIntensity (here the
// backlight intensity value is assumed to be normalized
// (directly represent the intensity (effective brightness of the
// light). Therefore, the constant of proportionality is set
// to 1.
// The value in each entry is computed as:
// I * brightnessScaleFactor
// where I is the index of each table entry.
// By creating this table at the start of each frame, only one
// divide is necessary, and 256 multiplications are required
// (for all pixels where the maximum pixel settings do not exceed
// the limit)
// This table is then used to compute the new pixel settings by
// performing table lookups (for pixels where the pixel settings
// do not exceed the limit)
//
// The percentage increase (PI) of a pixel setting scaled
// (multiplied) by the brightness scale factor (BSF) can
// be computed as; PI = BSF − 1 for cases where the BSF > 1
```

-continued

```
// Or: BSF = PI + 1 -> New Setting = (BSF) * Old Setting
// Or: New Setting = PI * Old Setting + Old Setting
// Where PI = (New Setting – Old Setting) / Old Setting
// The table lookup can effectively be used to scale the
// old setting based on the brightness scale factor
// (which is computed as the inverse of the backlight intensity
// for this example). It essentially increases the
// old setting by the associated percentage computed using
// the formula listed above.
// ------------------------------------------------------------
unsigned char *ComputeScaleTable(
    double globalScaleFactor)
{
    unsigned char *ScaleTable;
    double brightnessScaleFactor;
    unsigned int i, tmp;
    brightnessScaleFactor = 1/globalScaleFactor;
    ScaleTable = (unsigned char *) malloc(256*sizeof(unsigned
char));
    for (i=0; i<256; i++) {
        tmp = (unsigned char) (i * brightnessScaleFactor);
        if (tmp > 255) {
            ScaleTable[i] = 255;
        } else {
            ScaleTable[i] = tmp;
        }
    }
    return ScaleTable;
}
void ScalePixelRectangle(
    unsigned int col,
    unsigned int row,
    unsigned int width,
    unsigned int height,
    unsigned char *pixelBuffer,
    unsigned char *ScaleTable,
    unsigned short *PixelScaleTable,
    unsigned int pixelLimit) {
    glReadPixels(col,row,width,height,GL_RGBA,GL_UNSIGNED_BYTE,pixel
Buffer);
    ScalePixels(width,height,pixelBuffer,ScaleTable,PixelScaleTable
,pixelLimit);
      glRasterPos2i(col,row);
    glDrawPixels(width,height,GL_RGBA,GL_UNSIGNED_BYTE,pixelBuffer);
}
void ImageEnhance(
    HDC hdc,
    unsigned int imageWidth,
    unsigned int imageHeight,
    double globalScaleFactor)
{
    unsigned int pixelLimit; // Compute from globalScaleFactor
    unsigned int row,col;
    unsigned char *pixelBuffer;
    unsigned char *ScaleTable;
    unsigned short *PixelScaleTable;
    glEnable(GL_BLEND);
    glBlendFunc(GL_ONE,GL_ZERO);
    pixelBuffer = (unsigned char *)
malloc(PIXEL_BUFFER_SIZE*sizeof(unsigned char));
    pixelLimit = (unsigned int) floor(globalScaleFactor*255);
    ScaleTable = ComputeScaleTable(globalScaleFactor);
    PixelScaleTable = ComputePixelScaleTable( );
    for (row=0; row < imageHeight; row=row+PIXEL_RECT_HEIGHT) {
        for (col=0; col < imageWidth–PIXEL_RECT_WIDTH;
col=col+PIXEL_RECT_WIDTH) {
            if (row > imageHeight–PIXEL_RECT_HEIGHT) {
    ScalePixelRectangle(col,row,PIXEL_RECT_WIDTH,imageHeight–
row,pixelBuffer,ScaleTable,PixelScaleTable,pixelLimit); //
Shorter full rectangle
            } else {
```

-continued

```
    ScalePixelRectangle(col,row,PIXEL__RECT__WIDTH,PIXEL__RECT__HEIGHT,
pixelBuffer,ScaleTable,PixelScaleTable,pixelLimit); // Normal full
rectangle
            }
        }
        if (col > imageWidth−PIXEL__RECT__WIDTH) {
            if (row > imageHeight−PIXEL__RECT__HEIGHT) {
                ScalePixelRectangle(col,row,imageWidth−
col,imageHeight−
row,pixelBuffer,ScaleTable,PixelScaleTable,pixelLimit); //
Shorter, thinner upper right corner
                } else {
                    ScalePixelRectangle(col,row,imageWidth−
col,PIXEL__RECT__HEIGHT,pixelBuffer,ScaleTable,PixelScaleTable,pixelLimit
); // thinner end rectangle
            }
        }
    }
}
```

Various embodiments of methods and apparatus for optimizing an image in an LCD display have been discussed and described. It is expected that these embodiments or others in accordance with the present invention will have application to many electronic devices that use backlit displays. The disclosure extends to the constituent elements or equipment comprising such electronic devices and specifically the methods employed thereby and therein.

This disclosure is intended to explain how to fashion and use various embodiments in accordance with the invention rather than to limit the true, intended, and fair scope and spirit thereof. The foregoing description is not intended to be exhaustive or to limit the invention to the precise form disclosed. Modifications or variations are possible in light of the above teachings. The embodiment(s) was chosen and described to provide the best illustration of the principles of the invention and its practical application, and to enable one of ordinary skill in the art to utilize the invention in various embodiments and with various modifications as are suited to the particular use contemplated. All such modifications and variations are within the scope of the invention as determined by the appended claims, as may be amended during the pendency of this application for patent, and all equivalents thereof, when interpreted in accordance with the breadth to which they are fairly, legally, and equitably entitled.

We claim:

1. A display apparatus for optimizing a displayed image for use in an electronic device, comprising:

a display for presenting a visual image, the display comprising a pixel array;

a controller coupled to the display for rendering and storing visual images; and a processor coupled to the controller wherein the processor controls an intensity of a backlight, the backlight for illuminating the display, the processor further retrieves images from the controller, creates an optimized rendered visual image corresponding to the intensity of the backlight and returns the optimized rendered visual image to the controller for display, wherein the visual image is optimized by adjusting a level of a red, a green or a blue setting for a pixel of the pixel array, wherein the level of the red, the green or the blue setting is adjusted inversely proportionally to the intensity of the backlight.

2. The display apparatus of claim 1 wherein the level of the red, green or blue setting is adjusted inversely proportionally to the intensity of the backlight until a one of the settings would exceed a limit value, wherein the one of the settings is set to a maximum value and an other setting is increased by an amount proportional to the increase of the one.

3. The display apparatus of claim 1 wherein the level of the red, green or blue setting is adjusted inversely proportionally to the intensity of the backlight until a one of the settings would exceed a limit value, wherein the intensity of the backlight is adjusted until the one of the settings is approximately at the limit value.

4. A display apparatus for optimizing a displayed image for use in an electronic device, comprising:

a display for presenting a visual image, the display comprising a pixel array;

a controller coupled to the display for rendering and storing visual images;

a processor coupled to the controller wherein the processor controls an intensity of a backlight, the backlight for illuminating the display, the processor further retrieves images from the controller, creates an optimized rendered visual image corresponding to the intensity of the backlight and returns the optimized rendered visual image to the controller for display, wherein the visual image is optimized by adjusting only the brightness of pixels of the pixel array, the brightness of a pixel adjusted by adjusting a level of a red, a green or a blue setting.

5. The display apparatus of claim 4 wherein one of a hue and a saturation of the pixel of the pixel array is retained when the visual image is optimized.

6. The display apparatus of claim 4 wherein the pixel of the pixel array is adjusted in accordance with the intensity of the backlight at the pixel.

7. The display apparatus of claim 4 wherein the electronic device is one of a wireless communication device and personal digital assistant.

8. The display apparatus of claim 4 wherein the controller optimizes the visual image based on the intensity of the backlight according to one of a fixed value look up and a real-time calculation.

9. The display apparatus of claim 4 wherein the controller optimizes the visual image corresponding to the intensity of the backlight in real time with respect to an incoming image.

10. A display apparatus for optimizing a displayed image for use in an electronic device, comprising:

a display for presenting a visual image, the display comprising a pixel array;

a processor for determining an intensity of a backlight for illuminating the display; and a controller coupled to the display and the processor, wherein the controller optimizes the visual image corresponding to an intensity of the backlight by adjusting a level of a red, a green or a blue setting for a pixel of the pixel array, wherein the level of the red, the green or the blue setting is adjusted inversely proportionally to the intensity of the backlight.

11. The display apparatus of claim 10 wherein the level of the red, green or blue setting is adjusted inversely proportionally to the intensity of the backlight until one of the settings would exceed a limit value, wherein the one of the settings is set to a maximum value and an adjustment proportional to a change of the one of the settings is used for a remaining setting.

12. The display apparatus of claim 10 wherein the level of the the red, green or blue setting is adjusted inversely proportionally to the intensity of the backlight until a one of the settings would exceed a limit value, wherein the intensity of the backlight is adjusted until the one of the settings is approximately at the limit value.

13. A display apparatus for optimizing a displayed image for use in an electronic device, comprising:

a display for presenting a visual image, the display comprising a pixel array;

a processor for determining an intensity of a backlight for illuminating the display; and a controller coupled to the display and the processor, wherein the controller optimizes the visual image corresponding to an intensity of the backlight by adjusting only a brightness of pixels in a pixel array responsive to changes in the intensity of a backlight, the brightness of a pixel adjusted by adjusting a level of a red, a green or a blue setting.

14. The display apparatus of claim 13 wherein a hue of the pixel of the pixel array is retained when the visual image is optimized.

15. The display apparatus of claim 14 wherein the saturation of the pixel of the pixel array is retained when the visual image is optimized.

16. The display apparatus of claim 13 wherein the pixel of the pixel array is adjusted in accordance with the intensity of the backlight at the pixel.

17. The display apparatus of claim 13 wherein the electronic device is one of a wireless communication device and personal digital assistant.

18. The display apparatus of claim 13 wherein the controller optimizes the visual image based on the intensity of the backlight according to one of a fixed value look up and a real-time calculation.

19. The display apparatus of claim 13 wherein the controller optimizes the visual image corresponding to the intensity of the backlight in real time with respect to an incoming image.

20. The display apparatus of claim 13 wherein the controller optimizes the visual image corresponding to the intensity of the backlight in a buffer memory.

21. A method for optimizing an image in a display of an electronic device responsive to a change in an intensity of a backlight comprising:

determining a factor for adjusting the image according to the intensity of the backlight including determining a constant value for scaling a brightness of a pixel in the display; and adjusting only the brightness of pixels in a pixel array, using the factor, responsive to changes in the backlight intensity.

22. The method of claim 21 wherein the determining a factor further comprises:

determining a value for scaling a brightness of a pixel in the display to maintain a hue of the pixel.

23. The display apparatus of claim 21 wherein the determining a factor further comprises:

determining a constant value for scaling a brightness of a pixel to maintain a saturation of the pixel.

24. The method of claim 21 wherein the determining the factor further comprises one of:

determining the factor according to a table look up; and determining the factor according to a calculation using a value corresponding to the intensity of the backlight.

25. The method of claim 21 wherein the optimizing the image further comprises:

adjusting the image in a portion of the display according to the intensity of the backlight in the portion.

26. A display controller for providing an image optimized to a backlight intensity comprising:

a first input for receiving a first data to display as the image;

a second input corresponding to a backlight intensity of a display having a pixel;

an output for driving the pixel of the display; and a processor for adjusting a brightness of the pixel responsive to one of the first and second input, the processor adjusting a value for the red, the green or the blue setting for the pixel to adjust the brightness of the pixel in inverse proportion to the backlight intensity, wherein the processor adjusts the value for the red, the green or the blue setting for the pixel inversely proportionally to the backlight intensity until a one of the settings would exceed a limit value, wherein the one of the settings is set to a maximum value and an other setting is increased by the percentage increase of the one.

27. A method for optimizing an image in a display of an electronic device responsive to a change in an intensity of a backlight comprising:

determining a factor for adjusting the image according to the intensity of the backlight including determining a constant value for scaling a brightness of a pixel in the display;

adjusting the image using the factor; and determining the magnitude of a one of a red, a green and a blue setting for a pixel in the display inversely proportionally to the change in the intensity of the backlight unless the magnitude of the one exceeds a limit wherein the magnitude of the one is set to a maximum and a factor proportional to the one is determined for a remaining setting.

28. A display controller for providing an image optimized to a backlight intensity comprising:

a first input for receiving a first data to display as the image;

a second input corresponding to a backlight intensity of a display having a pixel;

an output for driving the pixel of the display; and a processor for adjusting a brightness of the pixel responsive to one of the first and second input, the processor adjusting a value for the red, the green or the blue a setting for the pixel to adjust the brightness of the pixel in inverse proportion to the backlight intensity.

29. The display controller of claim 28 wherein the second input is one of an indication of backlight intensity and a second data for use in adjusting the backlight intensity.

30. The display controller of claim 28 wherein the processor adjusts the value for the red, the green or the blue setting for the pixel to maintain a hue of the pixel.

31. The display controller of claim 28 wherein the processor adjusts a value for the red, the green, or the blue setting for the pixel to maintain a saturation of the pixel.

32. The display controller of claim 28 wherein a portion of the display is adjusted corresponding to the intensity of the backlight intensity in that portion of the display.

33. The display controller of claim 28 wherein the processor optimizes the visual image based on the backlight intensity according to one of a fixed value look up and a real-time calculation.

* * * * *